US007859489B2

(12) United States Patent
Furuichi

(10) Patent No.: US 7,859,489 B2
(45) Date of Patent: Dec. 28, 2010

(54) CURRENT DRIVE CIRCUIT FOR SUPPLYING DRIVING CURRENT TO DISPLAY PANEL

(75) Inventor: Shuji Furuichi, Kanagawa (JP)

(73) Assignee: Oki Semiconductor Co., Ltd. (JP)

( * ) Notice: Subject to any disclaimer, the term of this patent is extended or adjusted under 35 U.S.C. 154(b) by 1031 days.

(21) Appl. No.: 11/645,758

(22) Filed: Dec. 27, 2006

(65) Prior Publication Data

US 2007/0211043 A1 Sep. 13, 2007

(30) Foreign Application Priority Data

Mar. 7, 2006 (JP) ..... 2006-060621

(51) Int. Cl.
*G09G 3/30* (2006.01)

(52) U.S. Cl. ..... 345/76; 345/82

(58) Field of Classification Search ..... 345/76, 345/87, 98, 204, 82
See application file for complete search history.

(56) References Cited

U.S. PATENT DOCUMENTS 6,498,596 B1 * 12/2002 Nakamura et al. ..... 345/98
2004/0263437 A1 * 12/2004 Hattori ..... 345/76

FOREIGN PATENT DOCUMENTS

JP 2005-006250 1/2005

* cited by examiner

*Primary Examiner*—Chanh Nguyen
*Assistant Examiner*—Jonathan Blancha
(74) *Attorney, Agent, or Firm*—Studebaker & Brackett PC; Donald R. Studebaker

(57) ABSTRACT

A current driver circuit includes a DA conversion part for generating a display current whose magnitude corresponds to a value of a displayed data, a timing control part for generating a write controlling signal, and a plurality of electric current latching parts, each of which generates a driving current. Each of the electric current latching parts having a capacitor generates a display current whose magnitude corresponds to a magnitude of a voltage to which the capacitor is charged. Each of the elective current latching parts performs a reset operation that once discharges the capacitor in response to a reset signal generated by the timing control part. The current driver circuit can generate the driving current with high accuracy and improve the speed of response to the display device.

2 Claims, 6 Drawing Sheets

CURRENT DRIVE CIRCUIT FOR SUPPLYING DRIVING CURRENT TO DISPLAY PANEL

BACKGROUND OF THE INVENTION

1. Field of the Invention

The present invention relates to a current drive circuit for supplying a driving current to a display panel.

2. Description of the Related Art

A conventional current drive circuit for supplying a driving current to a display panel is disclosed by, for example, Japanese Patent Application Kokai No. 2005-6250.

FIG. 1 of the accompanying drawings is a circuit diagram of a current drive circuit. The current drive circuit supplies a driving current to a current drive type display device 1. The current drive circuit includes a reference current generating part 10, a digital-to-analog (DA) converter 20, a plurality of electric current latching parts 301 to 30*n* (n denotes an integer of two or more), and a timing controlling part 40.

The reference current generating part 10 generates a reference electric current Iref determined from a reference voltage Vref and a basis resistance Rref and generates a bias voltage VB whose magnitude corresponds to the reference electric current Iref. The reference current generating part 10 includes a p-channel MOS (PMOS) transistor 11 connected between a power supply electrical potential VDD and a node N1, a resistance 12 connected between the node N1 and an earth potential GND, and an operational amplifier (OP) 13. The reference voltage Vref is supplied to a first input terminal of the operational amplifier 13. A second input terminal of the operational amplifier 13 is connected to the node N1. A power output terminal of the operational amplifier 13 is connected to a gate terminal of the PMOS transistor 11. The bias voltage VB is supplied from the power output terminal of the operational amplifier 13.

The DA converter 20 generates a display electric current SNK having a magnitude corresponding to a value of display data Din. The display data Din is, for example, 8 bits data. The DA converter 20 includes eight PMOS transistors 210 to 217 and eight corresponding switches 220 to 227. Drain terminals of the PMOS transistors 210 to 207 are connected to a node N2. Gate terminals of the PMOS transistors 210 to 207, to which the bias voltage VB is applied, are connected to the node N2 together. The switches 220 to 227 are connected between a power supply electrical potential VDD and source terminals of the PMOS transistors 210 to 217, respectively. On/OFF switching operation of these switches 220 to 227 is respectively controlled in response to signals b0 to b7 which consist of the 8-bit display data Din. The PMOS transistors 210 to 217 are set so as to generate electric currents whose magnitude are respectively weighed by a factor of 1, 2, 4, 8, 16, 32, 64, and 128 of the reference electric current Iref when the switches 220 to 227 are turned on. In response to the display data Din having a value Di (i denotes the integer from 1 to n), the DA converter 20 generates the display electric current SNK, whose magnitude is represented as Di×Iref, from the node N2 thereof.

The electric current latching parts 301 to 30*n* have a similar configuration. The electric current latching part 301, for example, includes switches 31 and 32. The switch 31 is connected between the node N2 of the DA converter 20 from which the display electric current SNK is supplied and a node N3 of the electric current latching part 301. The switch 32 is connected between the node N3 and a node N4. These switches 31 and 32 are on-off controlled in response to a write-controlling signal W1 supplied by the timing controlling part 40. The electric current latching part 301 also has an n-channel metal oxide semiconductor (NMOS) transistor 33, a capacitor 34, and an NMOS transistor 35. Drain and gate terminals of the NMOS transistor 33 are connected to the node N3 together. Source terminal of the NMOS transistor 33 is connected to an earth potential GND. The capacitor 34 is connected between the node N4 and the earth potential GND. Gate and source terminals of the NMOS transistor 35 are connected to the node N4 and the earth potential GND, respectively. Drain terminal of the NMOS transistor 35 is connected to a display line of the display device 1 which is driven with a driving current OUT1 passing through the NMOS transistor 35.

The timing controlling part 40 periodically generates write-controlling signals W1 to Wn, which are sequentially supplied to the electric current latching parts 301 to 30*n*, respectively, in synchronization with the display data Din supplied to the DA converter 20.

An operation of the current driver circuit in FIG. 1 will be described. In the reference current generating part 10, the operational amplifier 13 produces a signal which is in accordance with a difference in voltages applied to the first and second input terminals thereof and supplies the signal to the gate terminal of the PMOS transistor 11. The PMOS transistor 11 is on-off controlled in response to the signal supplied by the operational amplifier 13. A voltage applied to the drain terminal of the PMOS transistor 11 is feed-backed to the second input terminal of the operational amplifier 13, so that the referential voltage Vref is eventually applied to the node N1. The reference electric current Iref flows through the PMOS transistor 11 and the resistor 12, and thus the bias voltage VB applied to the PMOS transistor 1, whose magnitude corresponds to the reference electric current Iref, is applied to the DA converter 20.

The switching operations of the switches 220 to 227 are controlled in response to a value (e.g., D1) of the display data Din supplied to the DA converter 20. A weighed electric current flows to one of the PMOS transistors 210 to 217 connected to the switch 220 to 227 which is turned on. The display current SNK having a magnitude D1×Iref, which corresponds to the value D1 of the display data Din, is supplied from the node N2 of the DA converter 20 through the PMOS transistor 210.

The timing controlling part 40 supplies a write-controlling signal to either one of the electric current latching parts 301 to 30*n*. The write-controlling signal W1 is supplied to the current latching part 301 to which the display current SNK having a magnitude D1×Iref corresponding to the value D1 of the display data Din is applied. It is to be noted that the write-controlling signals W2 to Wn are not supplied to other electric current latching parts 302 to 30*n* while the write-controlling signal W1 is supplied to the electric current latching part 301. The switches 31 and 32 of the electric current latching part 301 are turned on in response to the write-controlling signal W1, and thus the display electric current SNK generated by the DA converter 20 flows to the NMOS transistor 33. Accordingly, the driving current OUT1 having a magnitude corresponding to the magnitude of the display electric current SNK, that is, D1×Iref, flows to the NMOS transistor 35. The capacitor 34 is charged to a gate voltage of the NMOS transistor 35 at the time when the switches 31 and 32 are turned on.

When a value of the display data Din changes from D1 to D2, the write-controlling signal W1 supplied by the timing controlling part 40 is stopped, and then a write-controlling signal W2 is supplied to the electric current latching part 302. As a result, a driving current OUT2 whose magnitude is represented as D2×Iref flows to the NMOS transistor 35 of the electric current latching part 302.

On the other hand, the switches 31 and 32 of the electric current latching part 301 are turned off in response to the stop of the write-controlling signal W1, and thus the electric current flowing to the NMOS transistor 33 of the electric current latching part 301 is stopped. The capacitor 34 of the electric current latching part 301 is electrically charged to the gate voltage having a magnitude corresponding to the electric current of D1×Iref, so that the driving current OUT1 keeps flowing to the NMOS transistor 35 of the electric current latching part 301.

The electric current latching parts 301 to 30*n*, each of which performs in a similar way, generate driving currents OUT1 to OUTn, respectively. The driving currents OUT1 to OUTn whose magnitude correspond to the values D1 to Dn of the display data Din keep flowing to the NMOS transistors 35 of the electric current latching parts 30A1 to 30An, respectively.

However, there are the following difficulties in the above-described current drive circuit. The driving currents OUT1 to OUTn generated by the electric current latching parts 301 to 30*n*, respectively, vary according to the values of the display data Din. The driving currents OUT1 to OUTn are dependent on the voltages charged to capacitors 34 of electric current latching parts 301 to 30*n*, respectively. The magnitude of the driving electric currents OUT1 to OUTn are determined from voltages at which the electric current latching parts 301 to 30*n* are charged when the write-controlling signals W1 to Wn are supplied. Therefore, the voltages charged to the capacitors 34 are required to vary according to new driving currents OUT1 to OUTn while the write-controlling signals W1 to Wn are supplied. However, each of the electric current latching parts 301 to 30*n* dose not include a circuit for discharging electric charges retained in the capacitor 34 sufficiently. If the driving current having a magnitude zero, for example, is generated in response to the next display data Din, charges retained in the capacitor 34 can not be completely discharged and a voltage at the node N4 is retained at a threshold voltage of the NMOS transistor 33. Therefore, the above-mentioned current drive circuit can not generate the driving currents with high accuracy if the driving currents OUT1 to OUTn are small.

A time period necessary for charging the capacitor 34 is reversely proportional to the magnitude of the display electric current SNK, so that it takes much time to sufficiently the capacitor if the display currents SNK are small. Therefore, there arises a difficulty in speeding up the display speed.

SUMMARY OF THE INVENTION

It is an object of the present invention to provide a current drive circuit capable of generating a driving current with high accuracy and high response speed.

According to one aspect of the present invention, there is provided an improved driving circuit for driving a display panel which displays an image on the basis of picture signals. The driving circuit includes a display current generating circuit for generating a display current having a magnitude corresponding to a value of pixel data, the pixel data having magnitudes on the basis of the picture signals and being supplied in sequence in synchronization with a synchronous timing of the picture signals. The driving circuit also includes a write controlling signal generating means for generating a write controlling signal which is synchronized with the synchronous timing, and a plurality of line driving current output circuits. Each of line driving current output circuits generates a line driving current corresponding to the display current in response to the write controlling signal, retains the line driving current, and outputs the line driving current through an output terminal thereof. The write controlling signal generating circuit generates a reset signal in synchronization with the picture signals and each of the line driving current output circuits performs a reset operation so as to release the line driving current retained thereby in response to the reset signal.

Each of the line driving current outputting circuits performs a reset operation that the line driving current is once released in response to the reset signal before the line driving current is retained thereby. The current drive circuit can generate a driving current with high accuracy and can increase the speed of response.

DETAILED DESCRIPTION OF THE INVENTION

Embodiments of the present invention will now be described by way of examples with reference to the following detailed description and accompanying drawings. It is to be noted that the present invention is not limited to the drawings.

First Embodiment

Figure 1:
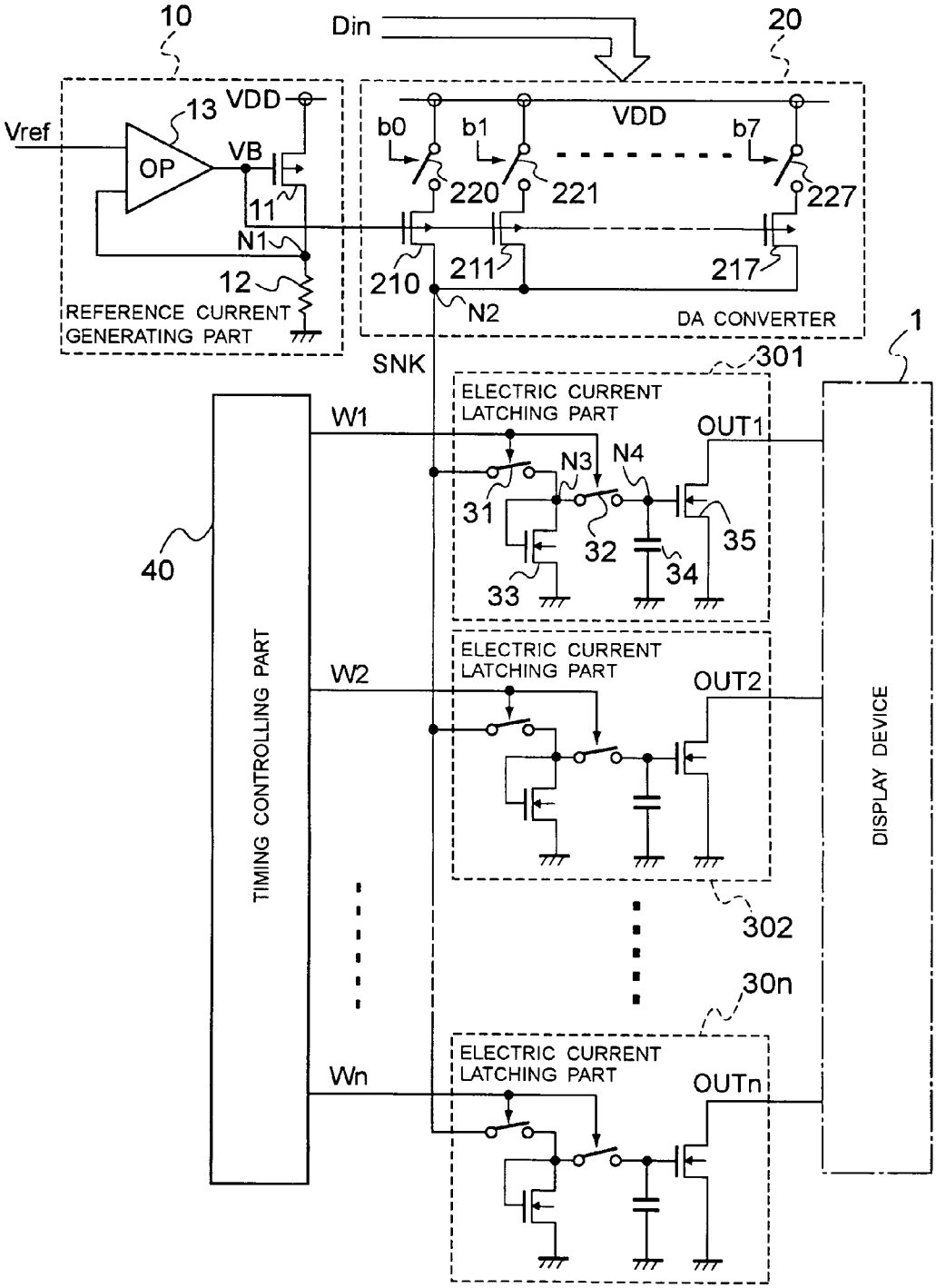
FIG. 1 RELATED ART
FIG. 1 is a schematic diagram of a related current drive circuit.
Figure 2:
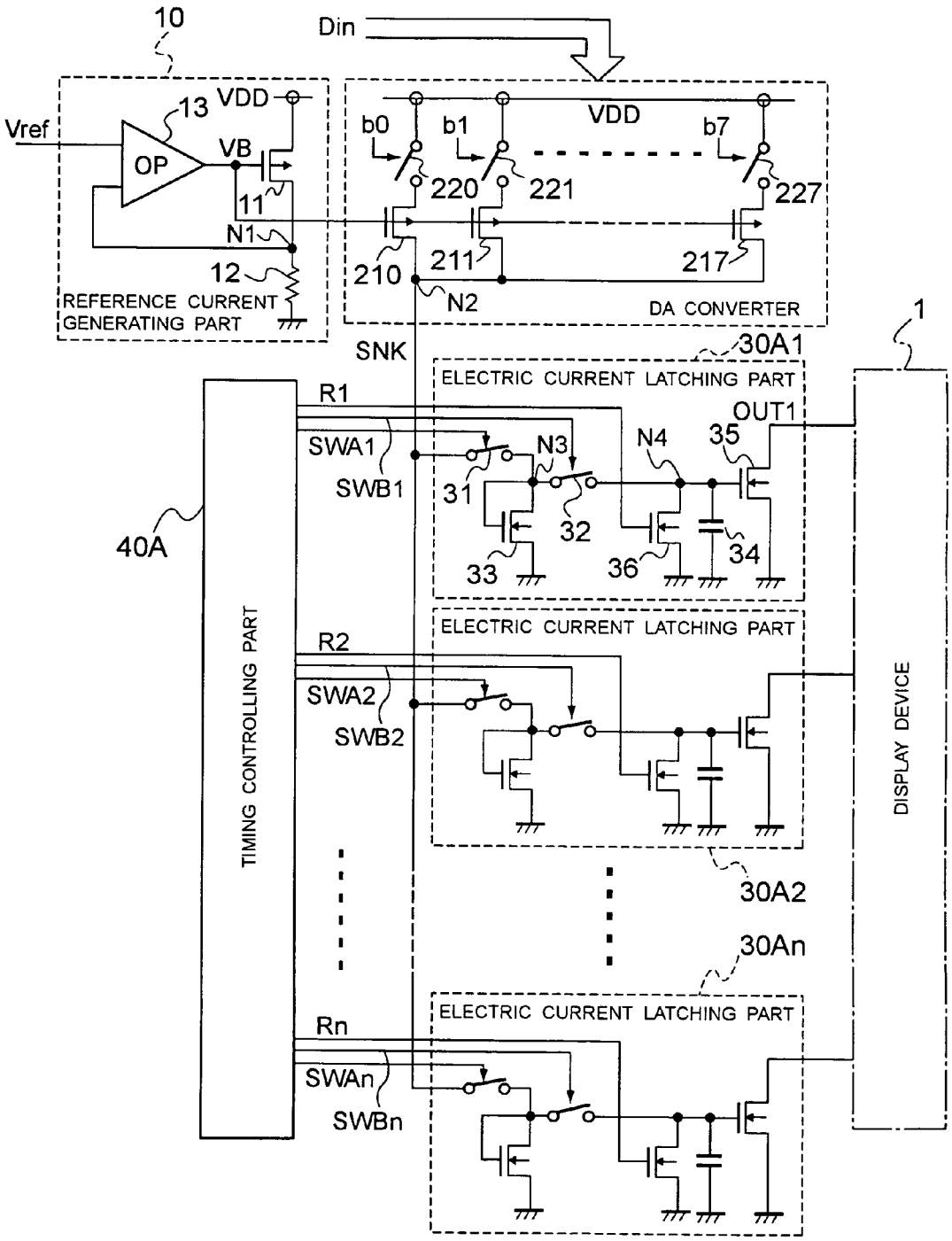
FIG. 2 is a schematic diagram showing a current drive circuit that is a first embodiment of the present invention.

FIG. 2 is a block diagram showing a current drive circuit that is a first embodiment of the present invention. Components in FIG. 2 which operate in the same manner as those in FIG. 1 are denoted by the same reference numerals.

This current drive circuit supplies an electric current for driving a current drive type display device 1. The current drive circuit includes a reference current generating part 10, a DA converter 20, a plurality of electric current latching parts 30A1 to 30An, and a timing controlling part 40A. It is to be noted that the electric current latching parts 30A1 to 30An (n denotes an integer of two and more) according to the first embodiment are different from those shown in FIG. 1.

The reference current generating part 10 generates a reference electric current Iref determined with a reference voltage Vref and a basis resistance Rref, and generates a bias voltage VB whose magnitude corresponds to the reference electric current Iref. The reference current generating part 10 includes a PMOS transistor 11 connected between a power-supply potential VDD and a node N1, a resistance 12 connected between the node N1 and an earth potential GND, and an operational amplifier 13. The reference voltage Vref is supplied to a first input terminal of the operational amplifier 13, and a second input terminal of the operational amplifier 13 is connected to the node N1. An output terminal of the operational amplifier 13, from which the bias voltage VB is generated, is connected to a gate terminal of the PMOS transistor 11.

The DA converter 20 generates a display electric current SNK having a magnitude corresponding to a value of display data Din. The display data Din is, for example, 8-bit data. The DA converter 20 includes eight PMOS transistors 210 to 217 and eight corresponding switches 220 to 227. Gate terminals of the PMOS transistors 210 to 207 are connected to a node N2 together. Gate terminals of the PMOS transistors 210 to 207, to which the bias voltage VB is applied, are connected to the node N2 together. The switches 220 to 227 are connected between a power supply electrical potential VDD and source terminals of the PMOS transistors 210 to 217, respectively. ON/OFF switching operation of these switches 220 to 227 is respectively controlled in response to signals b0 to b7 which consist of the 8 bits display data Din. The PMOS transistors 210 to 217 are configured to generate electric currents whose magnitude are respectively weighed by a factor of 1, 2, 4, 8, 16, 32, 64, and 128 of the reference electric current Iref when the switches 220 to 227 are turned on. In response to the display data Din having a value Di (i denotes an integer from 1 to n), the DA converter 20 generates the display electric current SNK, whose magnitude is represented as Di×Iref, from the node N2 thereof.

The electric current latching parts 30A1 to 30An have the same components and configuration. The electric current latching part 30A1, for example, has a switch 31 connected between a node N2 of the DA converter 20 and a node N3 thereof and a switch 32 connected between the node N3 and a node N4 as shown in FIG. 2. ON/OFF switching operations of these switches 31 and 32 are controlled in response to write-controlling signals SWA1 and SWB1 generated by the timing controlling part 40A.

The electric current latching part 30A1 further includes an NMOS transistor 33, a capacitor 34, an NMOS transistor 35 and an NMOS transistor 36. Drain and gate terminals of the NMOS transistor 33 is connected to the node N3 together, and source terminal of the NMOS transistor 33 is connected to an earth potential GND. The capacitor 34 for retaining a bias voltage is connected between the node N4 and the earth potential GND. The NMOS transistor 36 is connected between the node N4 and the earth potential GND, to a gate terminal of which a reset signal "R1" is supplied by the timing controlling part 40A. The drain terminal of the NMOS transistor 35 is connected to a corresponding display line of the display device 1. A driving current OUT1 flowing to the NMOS transistor 35 is supplied to the display device 1, so as to drive the display device.

The timing controlling part 40A periodically generates write-controlling signals SWA1 to SWAn, SWB1 to SWBn, and reset signals R1 to Rn which are supplied to the electric current latching parts 30A1 to 30An, respectively, in synchronization with the display data Din supplied to the DA converter 20. The timing controlling part 40A supplies the reset signal Ri (i denotes an integer from 1 to n) to the current latching part 30Ai immediately before supplying write-controlling signals SWAi and SWBi. The timing controlling part 40Ai stops the write-controlling signal SWBi prior to the write-controlling signal SWAi.

Figure 3:
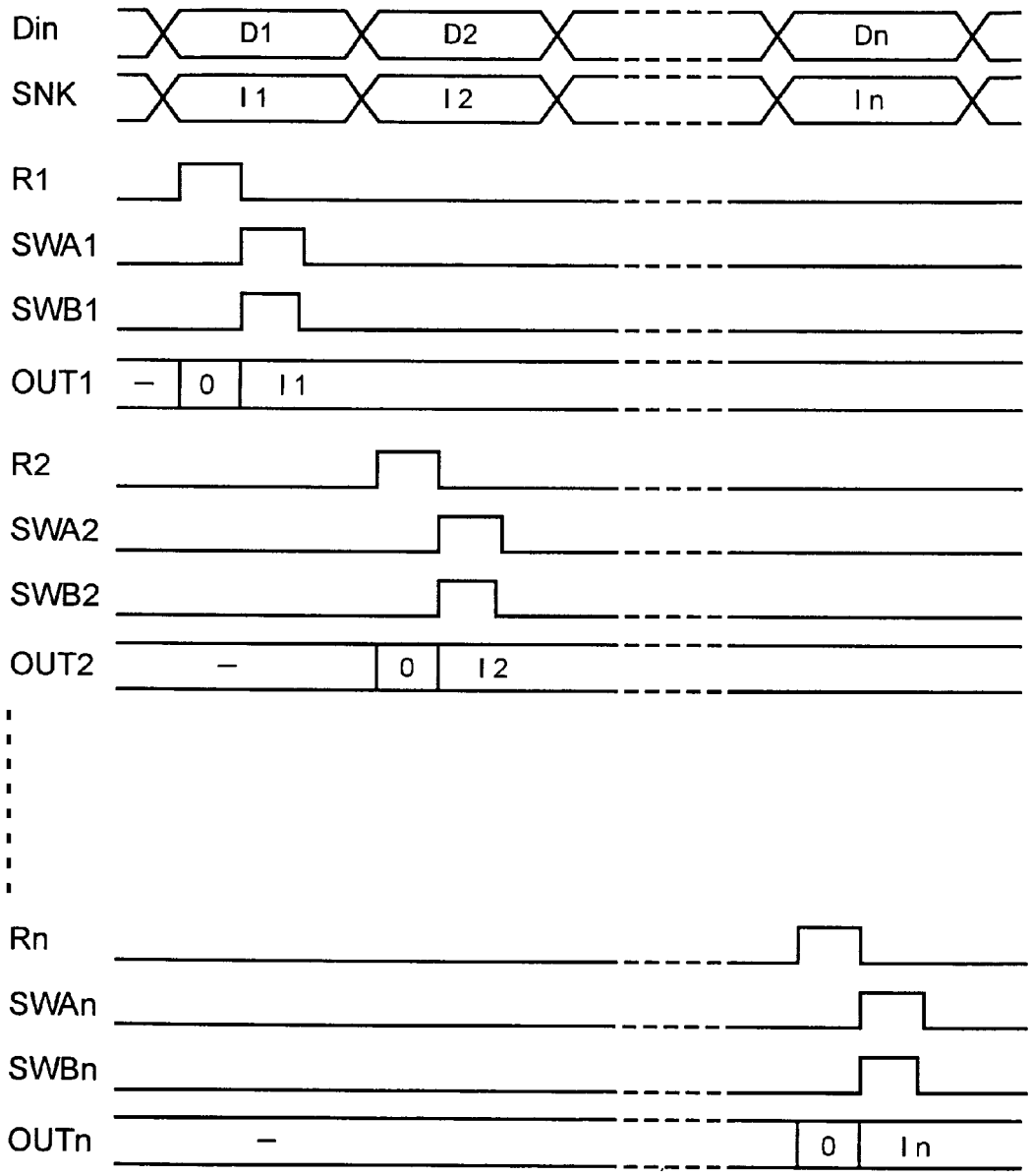
FIG. 3 is a signal waveform diagram of showing an operation of the current drive circuit shown in FIG. 2.

FIG. 3 is a signal waveform chart showing an operation of the drive circuit shown in FIG. 2. An operation of the first embodiment is described with reference to FIG. 3.

The reference current generating part 10 generates the reference electric current Iref determined with the reference voltage Vref and the basis resistance Rref, and supplies the bias voltage VB having a magnitude corresponding to the reference electric current Iref to the DA converter 20. The DA converter 20 generates a display electric current SNK, whose magnitude corresponds to a value of the display data Din, supplied from the node N2 to the electric current latching parts 30Ai.

The DA converter 20 receives the display data Din having a value D1 and generates the display electric current SNK whose magnitude corresponds to the value D1 of the display data Din.

The timing controlling part 40A generates a reset signal R1 and supplies the reset signal R1 to the electric current latching part 30A1 in a first-half period when the display data Din having the value D1 is supplied to the DA converter 20. Write-controlling signals SWA1 and SWB1 are not supplied to the electric current latching part 30A1 at the time when the reset signal R1 is supplied to the electric current latching part 30A1, and thus the switches 31 and 32 of the electric current latching part 30A1 are turned off. The NMOS transistor 36 of the electric current latching part 30A1 is turned on responding to the reset signal R1. Therefore, a voltage equivalent to the earth potential GND is applied to the node N4, and thus the capacitor 34 is discharged completely. The driving current OUT1 flowing to the NMOS transistor 35 becomes zero.

The timing controlling part 40A generates the write-controlling signals SWA1 and SWB1 next to the reset signal R1 and supplies the write-controlling signals SWA1 and SWB1 to the electric current latching part 30A1 in a latter-half period when the display data Din having the value D1 is supplied to the DA converter 20. No reset signal is generated. In response to the write-controlling signals SWA1 and SWB1, the NMOS transistor 36 of the electric current latching part 30A1 is turned off and the switches 31 and 32 are turned on, and a current mirror circuit including the NMOS transistors 33 and 35 is established. When the display electric current SNK supplied by the DA converter 20 flows to the NMOS transistor 33, the driving current OUT1 having a magnitude of "I1" which is same as the magnitude of the display electric current SNK flows to the NMOS transistor 35. The driving current OUT1 having the magnitude corresponding to the display electric current SNK flows to the NMOS transistor 33. The capacitor 34 is charged to a voltage which is same as the gate voltage of NMOS transistor 35 at this time. The write-controlling signal SWB1 is stopped and thus the switch 32 is turned off. Then, the write-controlling signal SWA1 is stopped and thus the switch 31 is turned off.

In the electric current latching part 30A1, the electric current flowing to the NMOS transistor 33 is stopped in response to the stop of the write-controlling signals SWA1 and SWB1. Since the capacitor 34 is charged to the gate voltage having a magnitude corresponding to the magnitude of D1×Iref, the driving current OUT1 having a magnitude of D1×Iref keeps flowing to the NMOS transistor 35 until the capacitor 34 is discharged.

When the display data Din having a value of D2 for the electric current latching part 30A2 is generated, a display electric current SNK whose magnitude corresponds to the value D2 is generated by the DA converter 20 and supplied to the electric current latching part 30A2. The electric current latching part 30A2 performs an operation similar to the above-mentioned electric current latching part 30A1.

The electric current latching parts 30A1 to 30An perform operations similar to the above-mentioned electric current latching part 30A1 and 30A2. The driving currents OUT1 to OUTn whose magnitude corresponds to the values of D1 to Dn of the display data Din keeps flowing to the NMOS transistors 35 of the electric current latching parts 30A1 to 30An, respectively until the capacitors 34 are discharged.

As mentioned above, the current drive circuit of the first embodiment includes the electric current latching parts 30Ai, each of which includes the NMOS transistor 36 for discharging the capacitor 34 used for retaining the bias voltage. The current drive circuit further includes the timing controlling part 40A which generates the reset signal Ri for discharging capacitor 34 immediately before the electric current latching part 30Ai retains the bias voltage having the magnitude corresponding to the display electric current SNK. The capacitors 34, which are completely discharged in response to the reset signal Ri, can be charged to the bias voltage having a magnitude corresponding to the driving current OUTi, so that the current drive circuit has an advantage of retaining the driving currents with high accuracy even if the driving current is zero.

Second Embodiment

Figure 4:
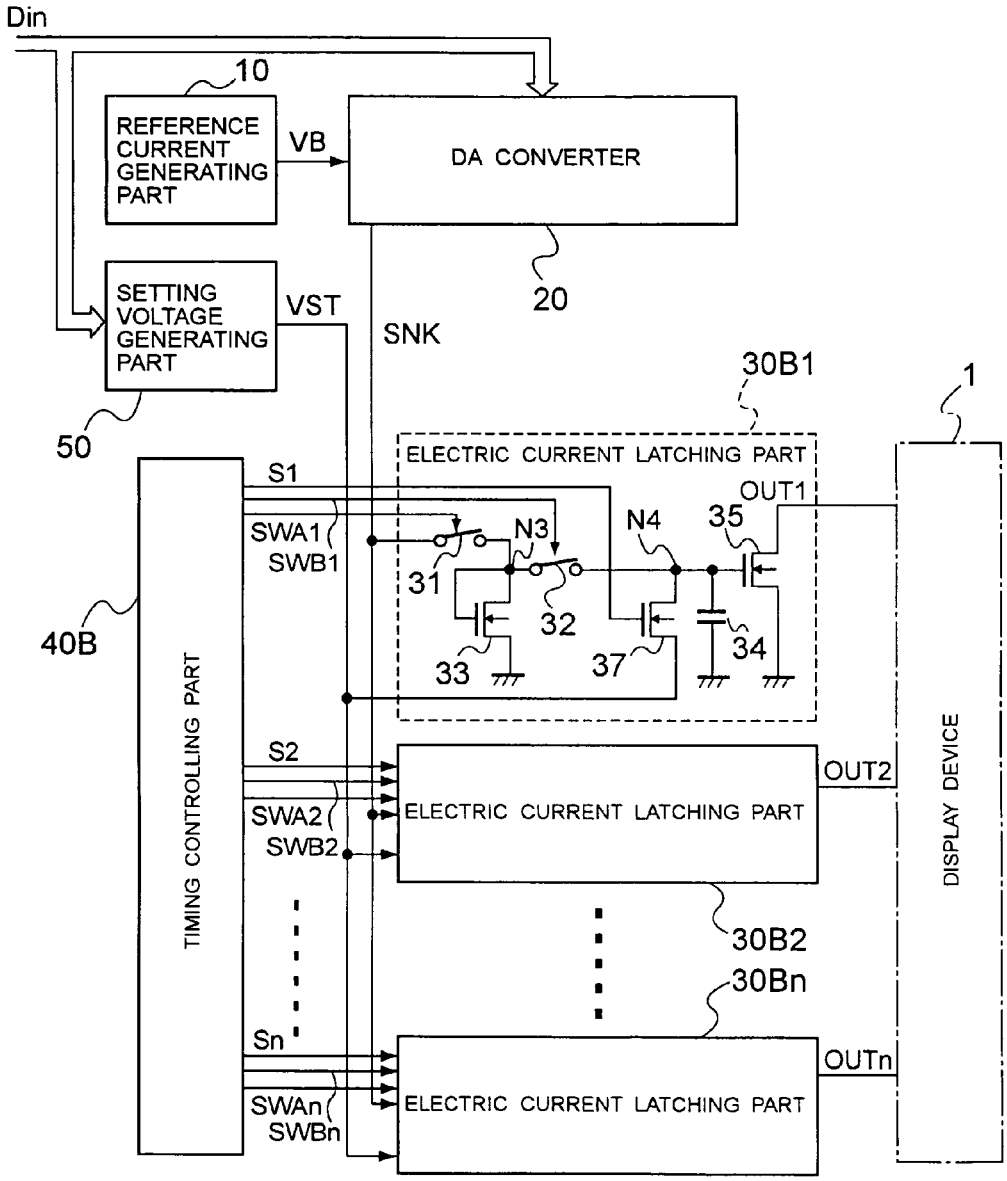
FIG. 4 is a schematic diagram showing a current drive circuit that is a second embodiment of the present invention.

FIG. 4 is a block diagram showing a current drive circuit according to a second embodiment of the present invention. Components in FIG. 4 which operate in the same manner as those in FIG. 2 are denoted by the same reference numerals.

The current drive circuit includes a reference current generating part 10, a DA converter 20, plural electric current latching parts 30B1 to 30Bn (n denotes an integer of two and more), a timing controlling part 40B and a setting voltage generation part 50. The reference current generating part 10 and the DA converter 20 have components similar to those shown in FIG. 1. The electric current latching parts 30B1 to 30Bn and the timing controlling part 40B have components slightly different from those shown in FIG. 1. As shown in FIG. 4, the current drive circuit is further provided with the setting voltage generation part 50.

Each of the electric current latching parts 30B1 to 30Bn has the same components. The electric current latching part 30A1, for example, is provided with switches 31 and 32 as shown in FIG. 4. The switch 31 is connected between a node N2 of the DA converter 20 and a node N3 of the electric current latching part 30A1. The switch 32 is connected between the node N3 and a node N4. Switching operations of these switches 31 and 32 are controlled in responding to write-controlling signals SWA1 and SWB1 supplied by the timing controlling part 40A.

The electric current latching part 30B1 includes an NMOS transistor 33, a capacitor 34, an NMOS transistor 35, and an NMOS transistor 37. Drain and gate terminals of the NMOS transistor 33 is connected to the node N3 together, and a source terminal of the NMOS transistor 33 is connected to an earth potential GND. The capacitor 34 for retaining a bias voltage is connected between the node N4 and the earth potential GND. Gate and source terminals of the NMOS transistor 35 is connected to the node N4 and the earth potential GND, respectively. A drain terminal of the NMOS transistor 37 is connected to the node N4. A setting signal S1 generated by the timing controlling part 40B is supplied to a gate terminal of the NMOS transistor 37. A setting voltage VST is applied to a source terminal of the NMOS transistor 37. The drain terminal of the NMOS transistor 35 is connected to a corresponding display line of the display device 1. A driving current OUT1 flowing through the NMOS transistor 35 is supplied to the display device 1 so as to drive the display device 1.

The drive circuit of the second embodiment is provided with the timing controlling part 40B, in place of the timing controlling part 40A shown in FIG. 2, for generating the reset signals R1 to Rn. The timing controlling part 40B generates set signals S1 to Sn (n is an integer from 1 to n), which are generated at the same timing.

The setting voltage generation part 50 generates a setting voltage VST having a magnitude corresponding to a value Di of the display data Din and supplies the setting voltage VST to each source of the NMOS transistors 37 of the electric current latching parts 30B1 to 30Bn. The setting voltage VST is equal to a gate voltage applied to each gate terminal of the NMOS transistors 35 whose magnitude corresponds to a value Di of the display data Din, that is, a bias potential. The value Di of the display data Din corresponds to the magnitude of the display electric current SNK.

Figure 5:
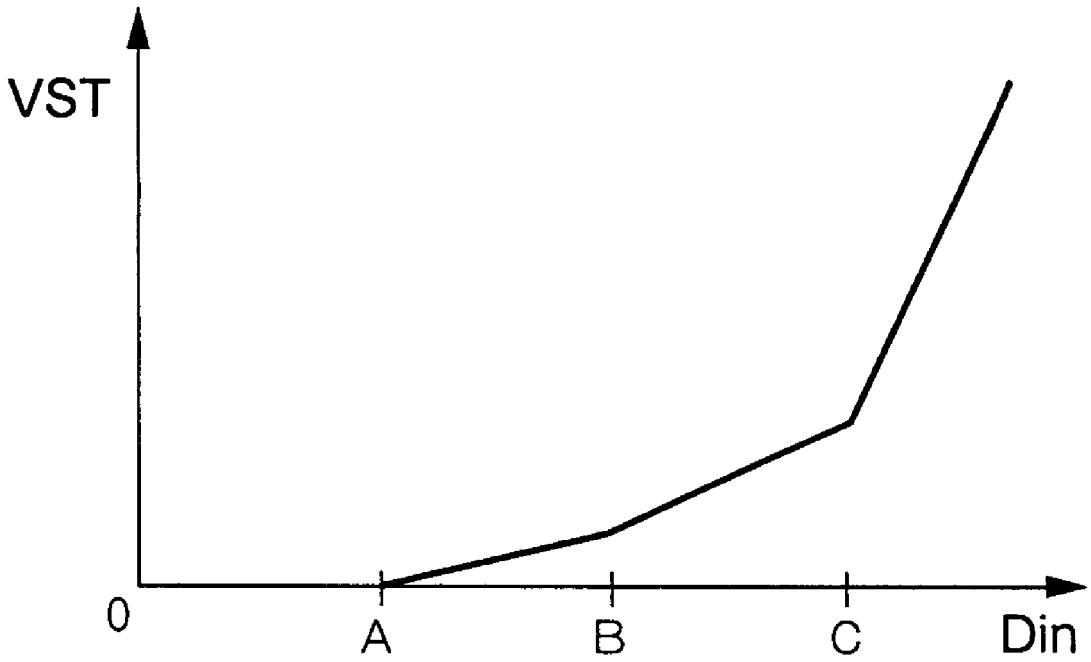
FIG. 5 is a graph showing a setting voltage (VST) versus a value of display data Din for the current drive circuit shown in FIG. 4.

FIG. 5 is a graph showing a setting voltage VST generated by the setting voltage generation part 50 versus a value of display data Din. Horizontal and vertical axes indicate a value of display data Din and a setting voltage VST, respectively.

This setting voltage generation part 50 generates a setting voltage VST in response to the display date Din in the following manner. If a value of the display data Din is equal to or smaller than A, a setting voltage VST of 0 is generated. If a value of the display data Din is between A and B, a setting voltage VST increasing in proportion to the value of the display data is generated. If a value of the display data Din is between B and C, a setting voltage VST increases in larger proportion to the magnitude of the display data. If a value of the display data Din is greater than C, a setting voltage VST increases in even greater proportion to the magnitude of the display data.

The setting voltage generation part 50 may include a resistive potential divider and switches for selecting are combined or may include a converter table having memory and a linear D/A converter.

Figure 6:
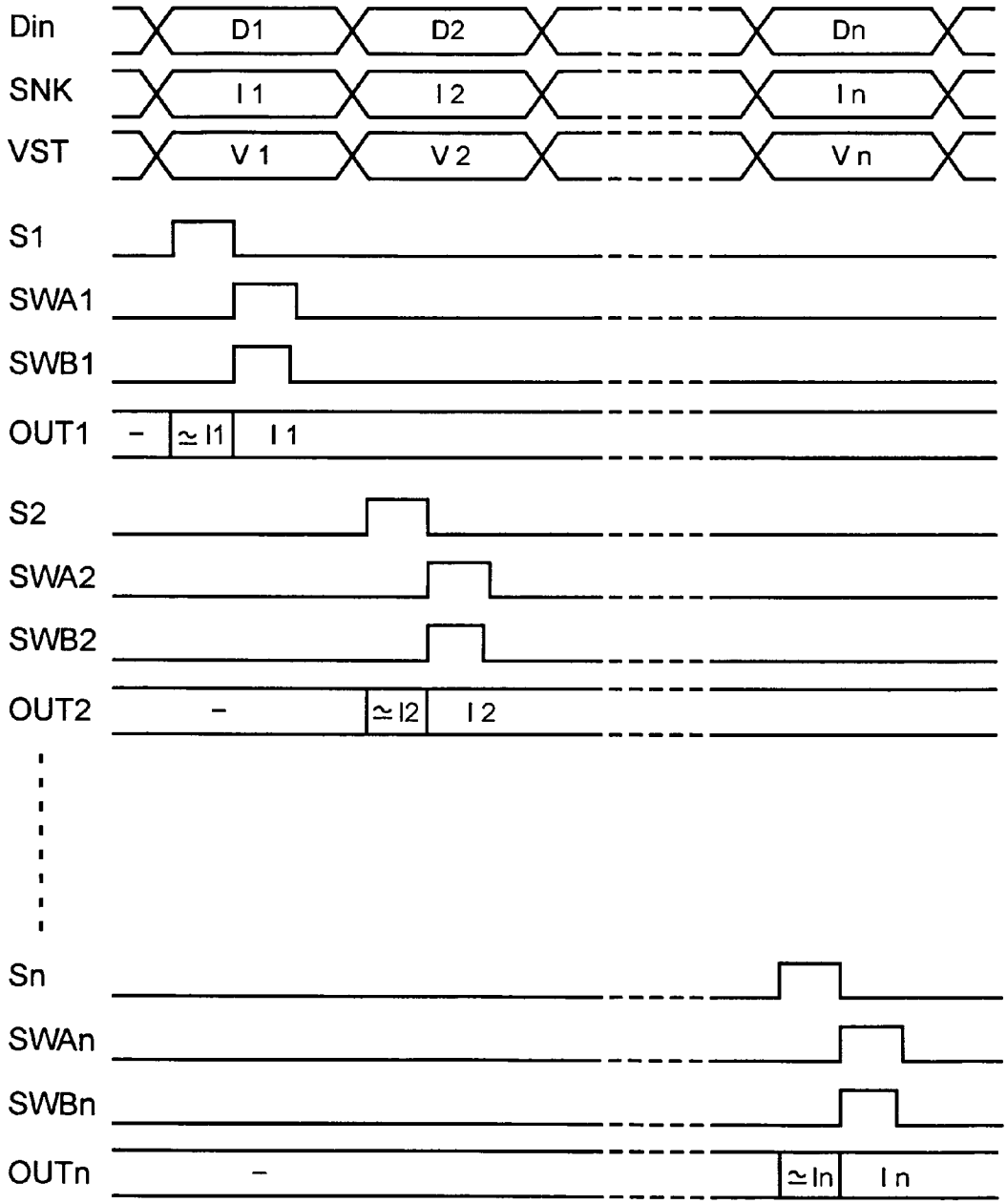
FIG. 6 is a signal waveform diagram showing an operation of the current drive circuit shown in FIG. 4.

FIG. 6 is a waveform chart showing an operation of the current driver circuit shown in FIG. 4. The operation of the current driver circuit in FIG. 4 will be described below with reference to FIG. 6.

The reference current generating part 10 generates the reference electric current Iref determined with the reference voltage Vref and the basis resistance Rref and supplies the bias voltage VB having a magnitude corresponding to the reference electric current Iref, to the DA converter 20. The DA converter 20 generates a display electric current SNK having a magnitude corresponding to a value of the display data Din, and the display electric current SNK is supplied from the node N2 to the electric current latching parts 30Bi. The display data Din is supplied to the setting voltage generation part 60 from which the setting voltage VST having a magnitude corresponding to the value of the display data Din is generated to each of the electric current latching parts 30Bi.

On the other hand, the timing controlling part 40B generates a set signal S1 and supplies the set signal S1 to the electric current latching part 30B1 during a first-half of the period when the display data Din have a value D1. Neither write-controlling signals SWA1 nor SWB1 is supplied to the electric current latching part 30B1 during the first-half period, and thus the switches 31 and 32 of the electric current latching part 30B1 are turned off. As a result, the NMOS transistor 37 of the electric current latching part 30B1 is turned on in response to the set signal S1. The setting voltage VST is applied to the node N4, and thus the capacitor 34 is charged to the setting voltage VST. The setting voltage generation part 60 is so set that the setting voltage VST substantially same as a bias potential applied to a gate terminal of the NMOS transistors 35 is generated. A magnitude of the setting voltage VST corresponds to the display electric current SNK (=I1) having a magnitude corresponding to a value D1 of the display data Din. As a result, a driving current OUT1 whose magnitude is substantially same as that of I1 flows to the NMOS transistor 35.

In a latter-half period when the display data Din has a value of D1, the timing controlling part 40B generates the write-controlling signals SWA1 and SWB1 next to the setting signal S1 and supplies the write-controlling signals SWA1 and SWB1 to the electric current latching part 30B1. The NMOS transistor 37 of the electric current latching part 30B1 is turned off and the switches 31 and 32 are turned on, so that an electric current SNK generated by the DA converter 20 flows to the NMOS transistor 33. Accordingly, a driving electric current OUT1, whose magnitude I1 is substantially same as the display electric current SNK, flows to the NMOS transistor 35. The capacitor 34 is charged to a gate voltage of the NMOS transistor 35 at this time. The write-controlling signal SWB1 is stopped and thus the switch 32 is turned off. Then, the write-controlling signal SWA1 is stopped and thus the switch 31 is turned off.

In the electric current latching part 30B1, the electric current flowing to the NMOS transistor 33 is stopped in response to the stop of the write-controlling signals SWA1 and SWB1. Since the capacitor 34 is charged to the gate voltage having a magnitude corresponding to a electric current having magnitude of I1 (=D1×Iref), the driving current OUT1 having a magnitude represented as D1×Iref keeps flowing to the NMOS transistor 35 until the capacitor 34 is discharged.

The DA converter 20 receives the display data Din having a value of D2 for the electric current latching part 30B2 and generates a display electric current SNK whose magnitude corresponds to the value D2 of the display data to the electric current latching part 30B2. The electric current latching part 30B2 performs an operation similar to the above-mentioned electric current latching part 30B1.

The electric current latching parts 30B1 to 30Bn perform operations similarly to each other. Driving currents OUT1 to OUTn having magnitude corresponding to the values of D1 to Dn of the display data Din keep flowing to the NMOS transistors 35 of the electric current latching parts 30B1 to 30Bn, respectively until the capacitors 34 of the electric current latching parts 30B1 to 30Bn are discharged.

As disclosed above, the current drive circuit of the second embodiment has the setting voltage generation part 50 and the NMOS transistors 37 of the electric current latching parts 30B1 to 30Bn. The setting voltage generation part 50 generates the setting voltage VST whose magnitude corresponds to the display electric current SNK and is substantially same as that of the gate voltage of NMOS transistor 35. Furthermore, the magnitude of the display electric current SNK corresponds to the value of the display data. Each of the NMOS transistors 37 provided with the electric current latching parts 30B1 to 30Bn is used for charging each capacitor 34 for retaining the bias voltage at the setting voltage VST. Thus, the second embodiment has a benefit similar to the first embodiment and further has a benefit that the speed of response can be improved.

The present invention is not limited to the above-mentioned embodiments and the embodiments can be variously modified as follows:

(1) The timing of the write-controlling signals SWAi and SWBi, the reset signal Ri, and the set signal Si which are generated by the timing controlling parts 40A or 40B is not limited to the examples showed in FIG. 3 and FIG. 6. For example, the current driving circuit can have an increased speed of response if the current drive circuit shown in FIG. 2 is so designed that a reset signal R2 is preliminarily supplied to a next electric current latch part 30A2 at the time when the display data Din has the value D1.

(2) The setting voltage VST and the values of the display data characteristics for the setting voltage generation part 50 is not limited to those illustrated in FIG. 5. For instance, the setting voltage generation part 50 may be so designed that it generates a setting voltage VST which is stepwise or constant as a function of the value of the display data.

(3) The electric current latching parts 30A and 30B drive the display device 1 from which the driving current OUT flows to the electric current latching parts 30A and 30B. Embodiment of the present invention may be so designed that the electric current latching parts 30A and 30B drive the display device 1 to which a driving current flows from the electric current latching parts 30A and 30B.

This application is based on Japanese Patent Application No. 2006-060621 which is herein incorporated by reference.

What is claimed is:

1. A driving circuit for retaining a display current in response to a write controlling signal and outputting said display current as a driving current, said display current whose magnitude corresponds to a value of an input date being supplied by display current generation means in sequence, comprising:

a first switch for connecting and disconnecting a first node to and from a second node in response to a first write controlling signal, said display current being supplied to said first node;

a first transistor whose gate and drain terminals are connected to said second terminal and whose source terminal is connected to a common terminal;

a second switch for connecting and disconnecting said second node to and from a third node in response to a second write controlling signal;

a capacitor connected across said third node and said common node, for retaining an electric potential at said third node;

a second transistor connected across said third node and said common node, which is turned on in response to a reset signal supplied prior to said first and second write controlling signals; and a third transistor whose gate and source terminals are connected to said third node and said common node, respectively, for outputting said display current from a drain terminal thereof.

2. A driving circuit for retaining a display current in response to a write controlling signal and outputting said display current as a driving current, said display current whose magnitude corresponds to a value of an input date being in sequence supplied by display current generation means, comprising:

a first switch for connecting and disconnecting a first node to and from a second node in response to a first write controlling signal, said display current being supplied to said first node;

a first transistor whose gate and drain terminals are connected to said second terminal and whose source terminal is connected to a common terminal;

a second switch for connecting and disconnecting said second node to and from a third node in response to a second write controlling signal;

a capacitor connected across said third node and said common node, for retaining an electric potential at said third node;

a second transistor connected across said third node and a bias electric potential, which is turned on in response to a reset signal supplied prior to said first and second write controlling signals, said bias electric potential whose magnitude corresponds to a value of said input data being generated; and a third transistor whose gate and source terminals are connected to said third node and said common node, respectively, for outputting said display current from a drain terminal thereof.

* * * * *